US007040912B2

(12) United States Patent
Mimoto et al.

(10) Patent No.: US 7,040,912 B2
(45) Date of Patent: May 9, 2006

(54) MECHANICAL LOCK TYPE CONNECTER

(75) Inventors: Kazuhiro Mimoto, Tokyo (JP); Shigeru Umeki, Tokyo (JP); Motoki Sone, Nara (JP); Nobuyuki Ohe, Nara (JP)

(73) Assignees: Sharp Kabushiki Kaisha, Osaka (JP); Yufu Gosei Kagaku, Ltd., Tokyo (JP)

( * ) Notice: Subject to any disclaimer, the term of this patent is extended or adjusted under 35 U.S.C. 154(b) by 90 days.

(21) Appl. No.: 10/445,046

(22) Filed: May 27, 2003

(65) Prior Publication Data

US 2003/0236018 A1 Dec. 25, 2003

(30) Foreign Application Priority Data

Jun. 21, 2002 (JP) ..... 2002-182033

(51) Int. Cl.
*H01R 13/627* (2006.01)

(52) U.S. Cl. ..... 439/352

(58) Field of Classification Search ..... 439/352, 439/350, 675, 328, 377, 357, 64, 298, 160
See application file for complete search history.

(56) References Cited

U.S. PATENT DOCUMENTS 5,603,631 A 2/1997 Kawahara et al.
6,475,016 B1 * 11/2002 Heidenreich et al. ..... 439/352
2002/0019175 A1 * 2/2002 Higuchi et al. ..... 439/680

FOREIGN PATENT DOCUMENTS

| | | |
|---|---|---|
| JP | 4-38680 U | 3/1992 |
| JP | 4-38681 U | 3/1992 |
| JP | 08-128579 A | 5/1996 |
| JP | 3041482 U | 7/1997 |
| JP | 2000-147317 A | 5/2000 |

* cited by examiner

*Primary Examiner*—J. F. Duverne
(74) *Attorney, Agent, or Firm*—Birch, Stewart, Kolasch & Birch, LLP

(57) ABSTRACT

A mechanical lock type connecter of the present invention is for a plug including a non-movable member connected to a cable, and a movable member that makes relative movement in an axial direction of the cable independently from the non-movable member and the cable. The mechanical lock type connecter has arm sections for (a) holding the non-movable member in accordance with movement of the movable member in a plug inserting direction caused by inserting the plug and (b) releasing the plug by movement of the movable member in a plug detaching direction. By thus using the mechanical lock plug, provided is a mechanical lock type connecter that is capable of stably connecting the plug with the connecter and that makes it possible to downsize connecting portions of the plug and the connecter.

11 Claims, 6 Drawing Sheets

MECHANICAL LOCK TYPE CONNECTER

FIELD OF THE INVENTION

The present invention relates to a mechanical lock type connecter capable of being connected to a plug having a movable finger grip at an end of a cable and the like, such as an optical fiber cable.

BACKGROUND OF THE INVENTION

An electronic device usually has a connecter, such as a mini jack, for connecting the electronic device with another electronic device, so as to transmit and receive signals. In order to connect between electronic devices by using such connecter, plugs provided at both ends of a connecting cable are respectively inserted into connecters of the electronic devices.

The connecter and the plug are disclosed, for example, in Japanese Publication for Utility Model, No. 3041482 (registration date: Jul. 2, 1997). FIG. 7 shows an arrangement of such connecter and the plug. As shown in FIG. 7, a plug 801 has a large diameter portion 802 at an end thereof, and a small diameter portion 803, which is a narrow portion, next to the large diameter portion 802. A connecter 811 has an inter-fitting section 812, which is, for example, made of a blade spring, for holding the plug.

In order to plug-in the plug 801 in the connecter 811, the plug 801 is inserted into the connecter 811 in the A-direction. When the plug 801 is inserted into the connecter 811, the inter-fitting section 812 is pressed by the plug 801, so as to be pushed away, along a surface of the large diameter portion 802, in a direction perpendicular to the direction in which the plug is inserted. Afterwards, when the large diameter portion 802 passes beyond the inter-fitting section 812, the inter-fitting section 812 is fitted with the small diameter portion 803 of the plug 801. This state is hereinafter referred to as a plug-in state of the plug 801 in the connecter 811.

In order to detach, from the connecter 811, the plug 801 in the plug-in state, the operation described above is reversed, so that the large diameter portion 802 directly displaces the inter-fitting section 812 of the connecter 811 as the plug 801 moves in a detaching direction (a direction opposite to the A-direction). Because the large diameter portion 802 directly displaces the inter-fitting section 812, it is possible to detach the plug 801 from the connecter 811 by applying a relatively weak force to the plug 801. Moreover, if a force applied to the plug 801 is strong enough to detach the plug 801 from the connecter 811, the plug-in state of the plug 801 in the connecter 811 is maintained.

Japanese Publication for Utility Model, No. 3041482 also discloses another connecter 821, which is, as shown in FIG. 8, an improvement of the connecter 811 shown in FIG. 7, having an inter-fitting section 822. A basic structure of the connecter 821 and operation for inserting and detaching a plug into and from the connecter 821 are the same as those of the connecter 811.

The plug 801 and the connecter 811 are advantageous in that the plug 801 and the connecter 811 are inexpensive, have simple structures, and that it is easy to insert and detach the plug 801 into and from the connecter 811. On the other hand, because the plug 801 is easily detached from the connecter 811 with a weak force, it is likely that accidental interruption occurs in transmitting and receiving signals between electronic devices that are connected with each other by a cable. In particular, in connecting between stationary electronic devices, there has been a problem that the plug 801 is detached due to vibration if the plug 801 and the connecter 811 are insufficiently matched.

According to the art disclosed in the publication, the cable is an electronic cable. However, it can easily be expected that it is possible to hold an optical fiber cable in a similar manner, and that interruption may occur in transmitting and receiving signals because the cable is easily detached.

Meanwhile, for example, in an optical plug connecter for Ethernet (a registered trademark) and an optical plug connecter disclosed in Japanese Publication for Unexamined Patent Application, Tokukai, No. 2000-147317 (publication date: May 26, 2000), in order to prevent the plug from being detached accidentally as described above, a mechanical lock is adopted for connecting between the plug and the connecter.

For example, according to the art disclosed in Japanese Publication for Unexamined Patent Application, Tokukai, No. 2000-147317, as shown in FIG. 9, a plug 831 is provided at an end of an optical fiber cable 833, and a claw portion 832 sticks out from a body portion of the plug 831. The claw portion 832 is fitted together with an engaging portion 842 of the connecter 841 when the plug 831 is inserted into the connecter 841. Because of this, it is possible to prevent the plug 831 from being accidentally detached from the connecter 841. In order to detach the plug 831 from the connecter 841, the plug 831 is pulled in the detaching direction while pressing the claw portion 832 toward the body of the plug 831.

However, because the mechanical lock plug 831 shown in FIG. 9 has, in addition to the body of the plug 841 to be inserted into the mechanical lock type connecter 841, the claw portion 832 sticking out pf the body of the plug 841, it is difficult to downsize the mechanical lock plug 831 due to the structure thereof. Furthermore, it is necessary that the connecter 841 has the engaging portion 842 for engaging the claw portion 832, and that an electronic device including the connecter 841 has space for installing the engaging portion 842 therein. Therefore, there is a problem that connecting portions of the plug 831 and the connecter 841 become large.

Moreover, because the mechanical locks used in the plug shown in FIG. 9 and in Ethernet (registered trademark) are so arranged that it is necessary to confirm a rotative direction of the plug in using a lock mechanism provided to the plug, insertion of the plug into the connecter is complex.

SUMMARY OF THE INVENTION

The object of the present invention is to provide a mechanical lock type connecter that is, by using a mechanical lock plug, capable of stably connecting between the plug and the connecter, and that makes it possible to downsize connecting portions of the plug and the connecter and to easily insert the plug into the connecter.

The plug 801 for the connecter 811 shown in FIG. 7 is usually connected to a cable. Therefore, there is a possibility that the plug 801 is easily detached from the connecter 811 by simply pulling the cable.

To solve this problem, the plug shown in FIGS. 6(*a*) and 6(*b*) is suggested. This plug has a movable section 201 connected to a finger grip section 204, and a non-movable section 202 connected to a cable (not shown). The movable section 201 is capable of freely moving, independently from the non-movable section 202, within a certain range in the directions indicated by the arrows X and Y.

FIG. 6(*a*) illustrates a state in which the movable section 201 and the finger grip section 204 have been moved in the X-direction as much as possible. FIG. 6(*b*) illustrates a state in which the movable section 201 and the finger grip section 204 have been moved in the Y-direction as much as possible. This plug is capable of freely choosing the states in FIGS. 6(*a*) and 6(*b*).

In a case in which the plug shown in FIGS. 6(*a*) and 6(*b*) is inserted into the connecter 811 shown in FIG. 7, for example, the plug-in state of the plug to the connecter 811 is established when the inter-fitting section 812 of the connecter 811 is fitted between the movable section 201 and the finger grip section 204 of the plug. If the cable is pulled while the plug is in the plug-in state, the non-movable section 202 connected to the cable is slid closer to the movable section 201, but the movable section 201, which is not connected to the cable, does not move. Therefore, the plug is not easily detached from the connecter even if the cable is pulled.

However, because the connecter 811 shown in FIG. 7 maintains the plug-in state of the plug only with a relatively light bias force by the inter-fitting section 812, there is a possibility that the plug is easily detached from the connecter 811 by a weak force applied externally, even if the plug in FIGS. 6(*a*) and 6(*b*) is used.

In this connection, the inventors of the present invention found that, by using the plug (for a mechanical lock) shown in FIGS. 6(*a*) and 6(*b*) that is suggested in order to prevent, with a simple arrangement, the plug from accidentally being detached (specifically, by using the plug having the movable section at a portion to be inserted into the connecter) and by creating, so as to deal with this plug, a connecter that is capable of performing mechanical locking, it is possible to stably connect between the plug and the connecter, and to downsize the connecting portions of the plug and the connecter.

Therefore, to attain the object above, a mechanical lock type connecter of the present invention, into and from which to be inserted and detached is a plug having (a) a non-movable member connected to a cable and (b) a movable member that makes relative movement (in other words, that allows, when the non-movable member and the cable are pulled, the non-movable member and the cable to move) in an axial direction of the cable independently from the non-movable member and the cable, includes a plug holding and releasing member for (c) holding the non-movable member in accordance with movement of the movable member in a plug inserting direction caused by inserting a plug, and (d) releasing the plug by movement of the movable member in a plug detaching direction.

According to the mechanical lock type connecter, by the plug holding and releasing member, the non-movable member is held in accordance with movement of the movable member in a plug inserting direction caused by inserting a plug, and the non-movable member is released by movement of the movable member in a plug detaching direction. Therefore, it is possible to hold and release the plug in accordance with the movement of the movable member of the plug.

Because of this, in a state in which the plug is inserted in the connecter, the movable member, which deals with holding and releasing of the plug, is not displaced even if the cable is pulled, thus preventing the plug from being detached from the connecter.

In other words, because the plug is inserted into and detached from the connecter in accordance with the movement of the movable member provided to the plug and movement of the plug holding and releasing member provided to the connecter, the plug and the connecter are connected by mechanical locking.

According to the connecter of the arrangement above, therefore, because a plug of such a structure suitable for downsizing is mechanically locked, it is possible to downsize the connecter itself. As a result, it is possible to downsize the connecting portions of the plug and the connecter.

It is intended that the connecter of the present invention be basically used in a high-performance electronic device. If the mechanical lock is provided to the connecter, a weak shock rarely causes the plug to be easily detached from the connecter, or the connecter and the plug to be easily mismatched. Therefore, the connecter of the present invention is suitable for such an electronic device for which high quality and high speed communication is necessary. For example, the connecter of the present invention is suitable for a personal computer and peripheral devices therefor (such as a built-in or external hard disk drive, a CD-ROM, a CD-R, a CD-RW, a DVD-ROM, a DVD-±R, a DVD-RW, and a DVD-RAM), an audio equipment, a video equipment, and the like.

Because the connecter of the present invention stabilizes the connection between the device and the cable, it is possible to provide a user-friendly electronic device requiring a high quality and high speed communication.

For a fuller understanding of the nature and advantages of the invention, reference should be made to the ensuing detailed description taken in conjunction with the accompanying drawings.

BRIEF DESCRIPTION OF THE DRAWINGS

FIG. 1(*b*) shows a state in which the plug is completely inserted into the connecter.

FIG. 6(*b*) shows a state in which the movable section of the mechanical lock plug is in a backward position.

DESCRIPTION OF THE EMBODIMENTS

Figure 6:
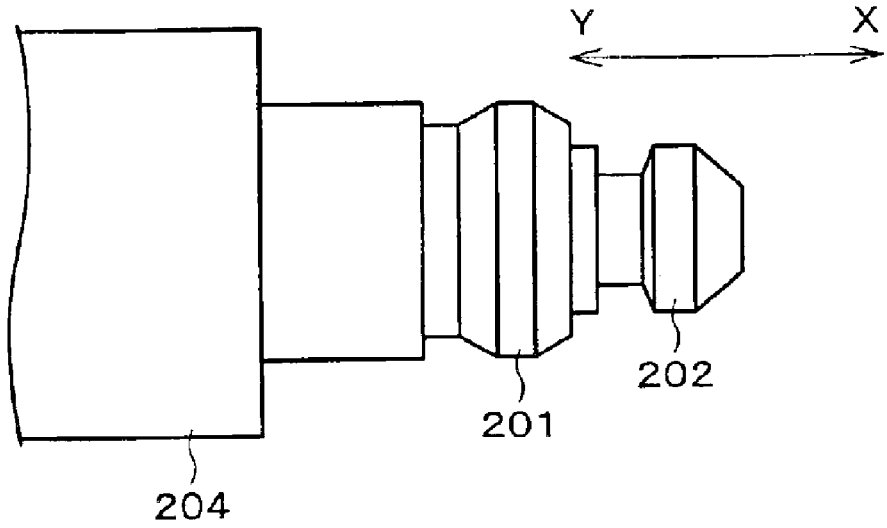
FIG. 6(*a*) shows a state in which the movable section of the mechanical lock plug is in a forward position.
Figure 6:
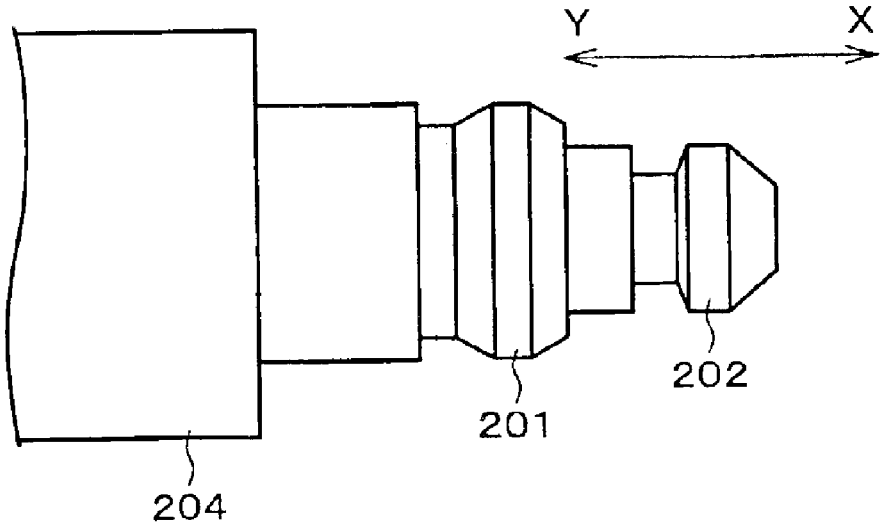
Figure 7:
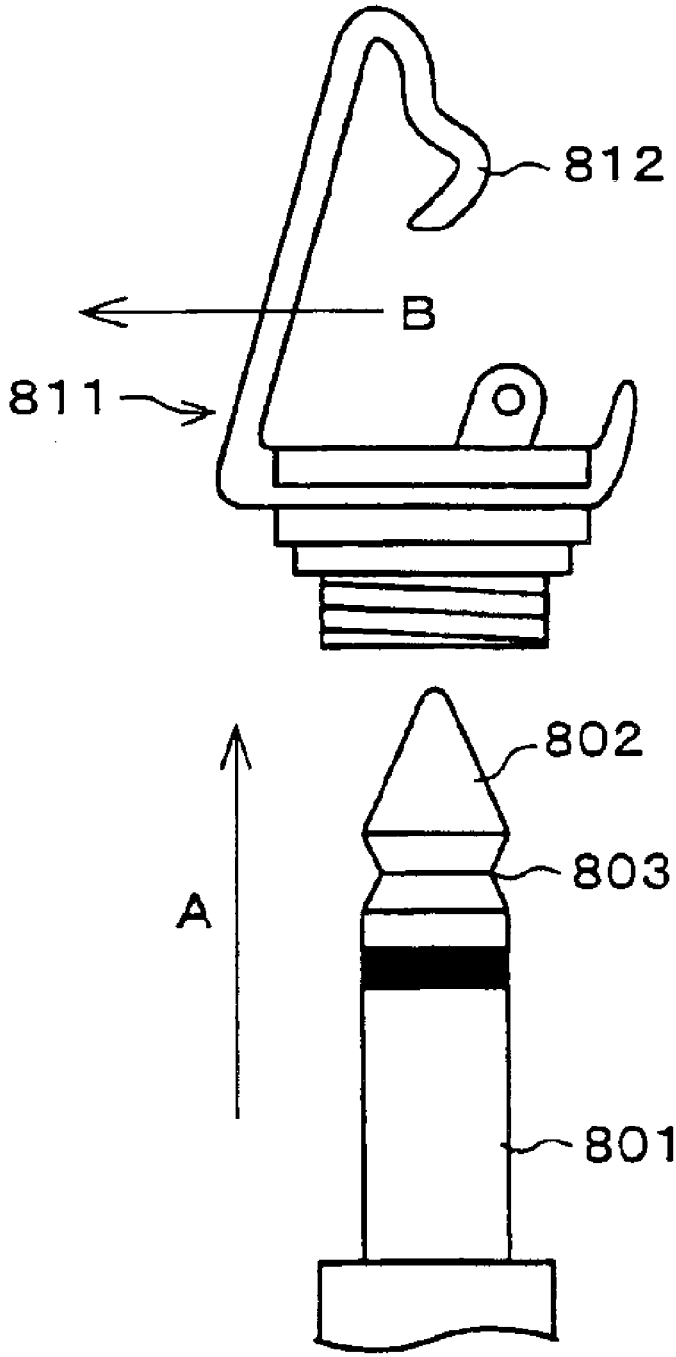
FIG. 7 Related Art
FIG. 7 is a schematic diagram illustrating a conventional connecter and a plug to be mounted therein.
Figure 8:
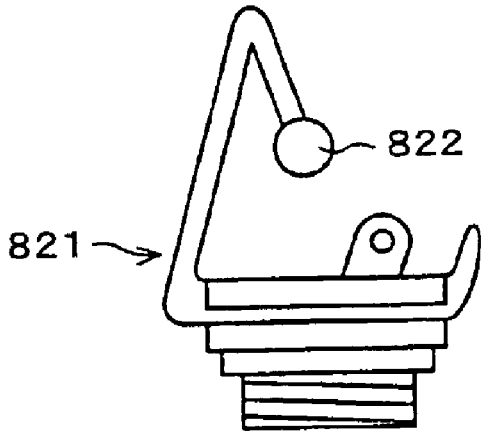
FIG. 8 (a) Related Art
FIGS. 8(*a*) and 8(*b*) are schematic diagrams illustrating another example of the connecter shown in FIG. 7.
Figure 8:
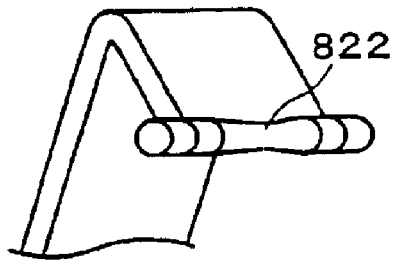
FIG. 8 (b) Related Art

The following describes an embodiment of the present invention. In the present embodiment, the mechanical lock plug shown in FIGS. 6(*a*) and 6(*b*) is used.

Figure 1:
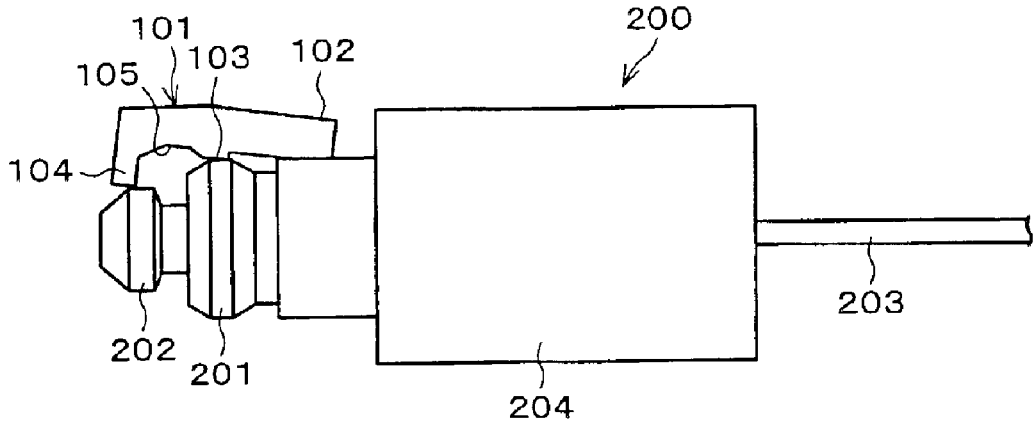
FIG. 1(*a*) shows a state in which the plug is being inserted into the connecter.
Figure 1:
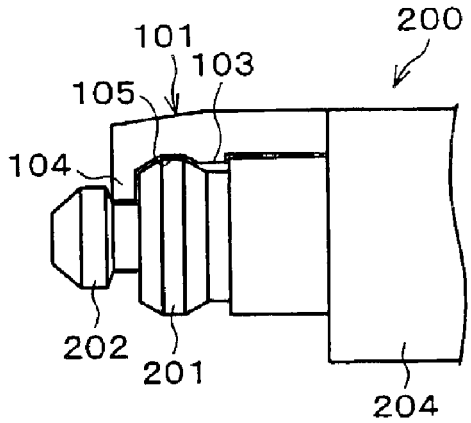

The mechanical lock type connecter of the present embodiment (hereinafter "the connecter") is, as shown in FIGS. 1(*a*) and 1(*b*), so arranged as to mechanically lock a plug 200 having a movable section 201. Before describing inserting operation of the plug into the connecter, the following describes a structure of the connecter, referring to FIG. 2.

Figure 2:
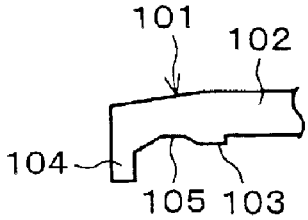
FIG. 2 is a schematic diagram illustrating an arm section of the connecter shown in FIGS. 1(*a*) and 1(*b*).

FIG. 2 shows a structure of an arm section (plug holding and releasing means) 101, which is a mechanical lock section in the connecter of the present embodiment. The arm section 101 has a fulcrum 102, a pressure accepting portion 103, and an engaging portion 104. By pressing the pressure accepting portion 103, the engaging portion 104 is circularly displaced at the fulcrum 102 as a center (in other words, the engaging portion 104 is bent at the fulcrum 102).

The arm section 101 is held at the fulcrum 102. By forming the fulcrum 102 of elastic material such as a spring, the arm section 101 is bent at the fulcrum 102 when the pressure accepting portion 103 or the engaging portion 104 is pressed, and thus pressed pressure accepting portion 103 or engaging portion 104 goes back to an initial position when released.

Next, referring to FIGS. 1(*a*) and 1(*b*), the following describes the inserting operation, in which the arm section 101 is used, of the plug 200.

FIGS. 1(*a*) and 1(*b*) illustrate change of states in inserting the plug 200 in the present embodiment.

The plug 200 is connected to a cable 203. The movable section (the movable member) 201 is connected to the finger grip section 204. The non-movable section (the non-movable member) 202 is connected to the cable 203. Thus, it is so arranged that the movable section 201 and the finger grip section 204 do not move in accordance with the non-movable section 202 and the cable 203, but independently move along an axial direction of the cable 203.

When the plug 200 is inserted, as shown in FIG. 1(*a*), the movable section 201 of the plug 200 presses up the pressure accepting portion 103 of the arm section 101 of the connecter. At this time, the engaging portion 104 is also pressed up in accordance with movement of the pressure accepting portion 103. Then, the non-movable section 202 of the plug 200 is inserted into the connecter smoothly. In the mean time, because stress is applied on the fulcrum 102 of the arm section 101, there is a force by which the arm section 101 is pressed back in a direction toward a center of the plug 200.

Further, when the plug 200 is inserted, as shown in FIG. 1(*b*), the movable section 201 of the plug 200 passes over the pressure accepting portion 103 of the arm section 101 and causes, by being fitted in a recess portion 105 of the arm section 101, the engaging portion 104 to hold the non-movable section 202 of the plug 200. The recess portion 105 has such a shape that an outer circumferential surface of the movable section 201 of the plug 200 can be fit therein so that it is possible to stably hold the plug 200 when the plug 200 is plugged-in.

In order to stably hold the plug 200, however, it is not sufficient that only the recess portion 105 holds the movable section 201, because it is the non-movable section 202 that is connected to the cable 203. Therefore, it is still possible that the non-movable section 202 moves in the inserting direction.

Therefore, if it is desired that the engaging portion 104 be omitted from the arrangement so as to, for example, save space therefor, it is necessary that the non-movable section 202 of the plug 200 be supported by some means. In such case, there may be provided an inclined portion, a hole, and the like for guiding the non-movable section 202 so as to hold a tip of the plug 200.

When the plug 200 is held inside the connecter, the plug 200 is not easily detached from the connecter even if the cable 203 is pulled, because the non-movable section 202 is held by the engaging portion 104. By pulling the finger grip section 204, however, the movable section 201 presses up the pressure accepting portion 103 of the arm section 101, and the engaging portion 104, which has been holding the non-movable section 202, releases the non-movable section 202, thereby making it possible to easily detach the plug 200.

According to the arrangement of the arm section 101, the engaging portion 104 is farther from the fulcrum 102 than the pressure accepting portion 103. Because of this, when the pressure accepting portion 103 is pressed, the engaging portion 104 moves more than the pressure accepting portion 103 does. Therefore, the engaging portion 104 does not hamper the non-movable section 202 from moving in and out in inserting and detaching the plug 200 into and from the connecter.

A plane in which the non-movable section 202 of the plug 200 and the engaging portion 104 contact is not completely perpendicular to the cable 203, but is slightly inclined so that the plug 200 is detached from the connecter when the cable 203 is pulled strongly, such as when someone tumbles over the cable. This arrangement is for preventing the connecter and the cable from breaking up, and preventing a device having the connecter from falling.

According to the arrangement of the connecter, the arm section 101, which is the plug holding and releasing means, holds the non-movable section 202 in accordance with movement of the movable member in the plug inserting direction caused by inserting a plug, and releases the non-movable member by movement of the movable member in the plug detaching direction. Therefore, it is possible to hold and release the plug in accordance with the movement of the movable section 201 of the plug 200.

Because of this, in the state in which the plug 200 is inserted in the connecter, the movable section 201, which deals with the holding and releasing of the plug, is not displaced even if the cable 203 is pulled, thus preventing the plug 200 from being detached from the connecter.

In other words, because the plug 200 is inserted into and detached from the connecter in accordance with the movement of the movable section 201 provided to the plug 200 and movement of the arm section 101 provided to the connecter, the plug 200 and the connecter are connected by mechanical locking.

According to the connecter of the arrangement above, therefore, because the plug 200 having such structure suitable for downsizing is mechanically locked, it is possible to downsize the connecter itself. As a result, it is possible to downsize the connecting portions of the plug 200 and the connecter.

Figure 3:
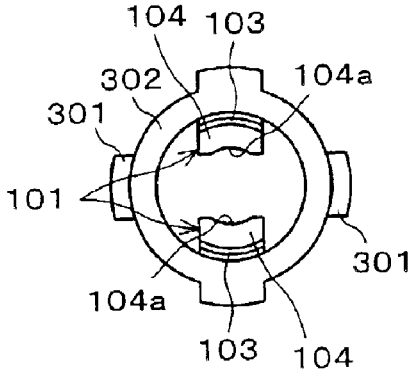
FIG. 3 is a front view illustrating a state in which the arm sections and hooks are fixed to a ring.
Figure 4:
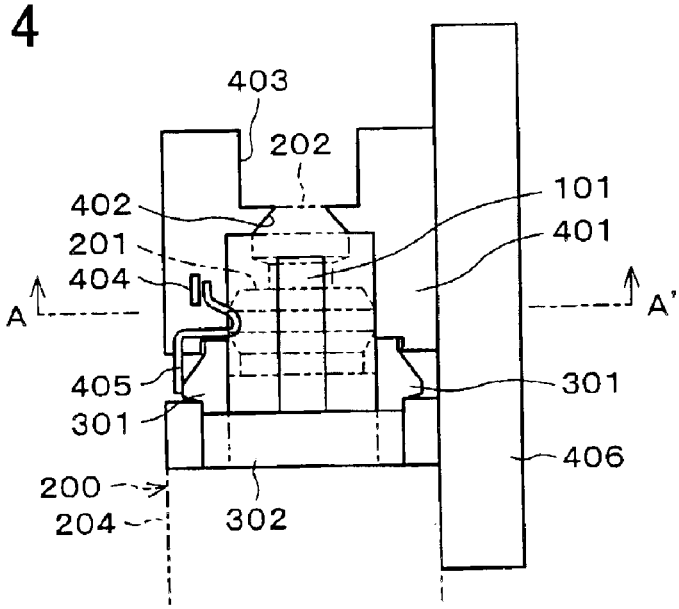
FIG. 4 is a schematic diagram illustrating a state in which the arm sections and the hooks are fixed to a holder.

The following specifically describes how to hold the arm sections 101 in the connecter, referring to FIGS. 3 and 4. In FIG. 3, the arm sections 101 are seen from the connecter for accepting the plug. In FIG. 4, a state in which the arm sections 101 are mounted to a holder 401 is seen from a side. In FIG. 4, the plug 200 is shown by the dotted lines.

As shown in FIG. 3, a pair of (two of) the arm sections 101 is located so as to face each other at space for accepting the plug. A pair of hooks 301 is located so as to be vertical to the pair of the arm sections 101.

The fewer the number of the arm sections 101, the easier to decide a range of force required for inserting and detaching the plug, and to form the arm section 101. On the other hand, the greater the number of the arm sections 101, the more stably the inserted plug 200 is held at a fixed position.

In the present embodiment, it is aimed that these two characteristics are realized by so providing the two arm sections 101 as to face each other. However, it is possible to increase or decrease the number of the arm sections 101 according to necessity. Likewise, it is possible to increase or decrease the number of the hooks 301. In the present embodiment, there are provided the pair of the hooks 301 in a direction vertical, when seen from the plug 200, to the pair of the arm sections 101.

The engaging portion 104 at an end of each of the arm sections 101 has a semicircular groove 104*a*, which is so shaped as to fit the non-movable section 202 of the plug 200. The semicircular groove 104*a* is for stably holding the plug 200 in the connecter when the plug 200 is inserted. For the same reason as in the engaging portion 104, the pressure accepting portion 103 may also have a semicircular groove that is so shaped as to fit the movable section 201 of the plug 200.

It is possible to so design the connecter as to be compact as a whole by providing the hooks 301 along a direction different, when seen from the plug 200, from a direction in which the arm sections 101 are provided. The arm sections 101 and the hooks 301 are integrally fixed to a ring 302, an inner diameter of which is the same as an outer diameter of the plug 200. This is for reducing space, which is left after the plug 200 is inserted, between the plug 200 and the connecter, so that mismatch between the plug 200 and the connecter does not occur.

Moreover, as shown in FIG. 4, the hooks 301 do not have anti-reverse needles, but are steeply inclined. This is for making it possible to easily remove the arm sections 101 if there is something wrong with the arm sections 101, the ring 302, and the like. It is possible to remove the arm sections 101 by respectively bending the hooks 301 in directions toward the center of the plug.

Here, in the holder 401 shown in FIG. 4, because distance between the two hooks 301 is approximately the same as the outer diameter of the plug 200, when the cable is pulled with strong force, such as when someone tumbles over the cable, the plug 200 prevents the hooks 301 from bending inside. Therefore, the hooks 301 do not allow the plug to be detached from the connecter. As described above, the plug is detached when the engaging portion 104 releases the non-movable section 202 of the plug 200.

As shown in FIG. 4, a recess portion 402 formed in the holder 401 is for appropriately adjusting positional relations between the non-moving section 202 and the holder 401 by using a guiding portion (an inclined portion) for guiding the non-moving section 202 at the end of the plug 200.

In the back of the recess portion 402, there is space 403 for containing an optical system (not shown) such as a lens, a light emitting element, and the like. It is possible to directly mount the optical system to the space 403. Alternatively, it may be so arranged that a unit (such as an optical pickup) containing an optical system such as a light emitting element, a light receiving element, and a lens is mounted to the space 403 of the holder 401.

In the holder 401 shown in FIG. 4, the recess portion 402 is provided to the holder 401 so as to guide the non-movable section 202 at the end of the plug 200. However, it may be so arranged that an inclined portion of an identical shape is provided to an optical system section, which includes a lens and the like, contained in the space 403, so as to guide the non-movable section 202 by the inclined portion. By providing the guiding portion not to the holder 401 but to the lens of the optical system to be mounted in the holder 401, it is possible to more precisely adjust the positional relations between the lens and the plug 200.

According to the description above, the fulcrum 102, the pressure accepting portion 103, the engaging portion 104 of each of the arm sections 101, the hooks 301 for supporting the arm sections 101, and the ring 302 are integrally formed, as an example. This is because it is possible to attain lower unit cost by using fewer parts.

However, there is a case in which the fulcrum 102, the pressure accepting portion 103, the engaging portion 104, the hooks 301, and the like require adjustment as to per unit strength. Therefore, there is a possibility that desired property cannot be attained by merely selecting material, thickness and the like.

For example, if it is desired to only adjust how easy the plug can be detached from the connecter when strong force is applied to the connecter, such as when someone tumbles over the cable, it is possible to meet the desire by using different material for the engaging portion only. Also, if the pressure accepting portion 103 is subjected to severe abrasion due to inserting and detaching of the plug, it is possible to constitute the pressure accepting portion 103 by such material that is tolerant to abrasion.

According to the description above, the stress at the fulcrum 102 is used as a force, caused when the plug 200 is being inserted into the connecter, by which the arm section 101 is pressed back in the direction toward the center of the plug 200. This is because it is possible to attain lower unit cost by using fewer parts. However, it may be so arranged that the fulcrum 102 is entirely movable, and that a force of elastic material (a spring, for example) is used as the force by which the arm section 101 is pressed back in the direction toward the center of the plug. By constituting the entire arm section 101 by such material as ceramic, which is tolerant to repeated movement, and by using a metal spring so as to generate stress, it is possible to easily design such a stout connecter into and from which the plug can be inserted and detached with a relatively weak force.

Figure 5:
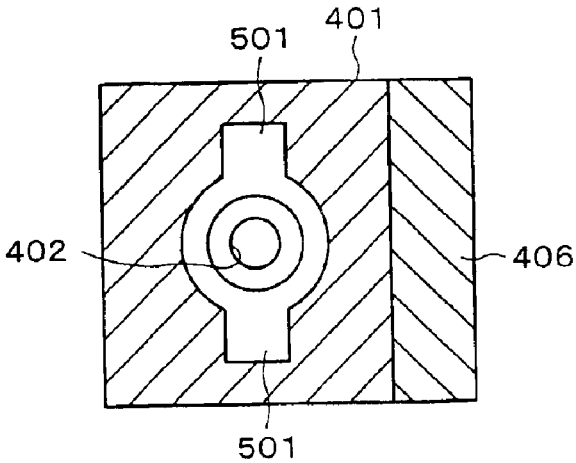
FIG. 5 is a cross-sectional view taken along line A—A of FIG. 4.

FIG. 5 is a cross-sectional view taken along line A—A of FIG. 4. As shown in FIG. 5, the holder 401 may have grooves 501 that are so formed as to closely fit the arm sections 101, respectively. By so arranging, when the plug is being inserted and detached, and when strong force is applied to the connecter, such as when someone tumbles over the cable, the arm sections 101 are not twisted, but are reliably displaced so as to spread out from the plug. Therefore, it is possible to mitigate deterioration of the arm sections 101.

Also, because the fulcrum 102 of each arm section 101 is only subjected to an expected force, it is easy to simulate deterioration of the arm sections 101 due to repeated inserting and detaching of the plug. Each groove 501 is so arranged that not only the fulcrum 102 but also the arm section 101 as a whole is fitted therein, so that the arm sections 101 are more hardly twisted.

It is necessary to ensure that width of each groove 501 is wider than that of each arm section 101. If the width of each groove 501 is the same as that of each arm section 101, a spring function of the arm sections 101 is not fully carried out, and there is a possibility that the arm sections 101 do not move back to initial positions thereof. It is also necessary to take into consideration that each groove 501 may become narrower than each arm section 101 due to heat and the like. However, if each groove 501 is so designed as to be much too wider than each arm section 101, there is a possibility that the arm sections 101 are twisted, as pointed out above.

Moreover, it may be so arranged that the holder 401 has a switch for detecting the inserted plug 200. In this case, as shown in FIG. 4, in which the plug 200 to be inserted is indicated by dotted lines, it is necessary that the hooks 301 are designed to be shorter than the plug 200 that is to be inserted. This is for making it possible to ensure, without being hampered by the arm sections 101, space for mounting therein an insertion detecting section (the switch) for the plug 200.

Specifically, as shown in FIG. 4, a first metal fitting 404 and a second metal fitting 405 are provided, as a plug insertion detecting switch, in the holder 401. When the plug 200 is inserted, the second metal fitting 405 is pressed against the first metal fitting 404. This causes the first metal fitting 404 and the second metal fitting 405 to be electrically connected by contacting each other. Thus, it is detected that the plug 200 is inserted.

As shown in FIG. 4, the holder 401 may be mounted to a substrate 406. In this case, the arm section 101 is so mounted as to be horizontal to the substrate 406. By thus mounting the arm section 101 so as to be parallel to the substrate 406, it is possible to shorten distance between the substrate 406 and a central portion of the connecter. The more freely distance between the substrate 406 and the central portion of the connecter is designed, the more flexibly a device having the connecter can be designed. Although, in FIG. 4, the plug insertion detecting section (the first metal fitting 404 and the second metal fitting 405) is so provided on a side opposite, when seen from the plug 200, to a side on which the substrate 406 is provided, the plug insertion detecting section may be provided on the side on which the substrate 406 is provided.

It is possible to provide the connecter of the present embodiment to various electronic devices, such as a DVD (Digital Versatile Disk) player, a personal computer and peripheral devices therefor, a digital STB (Set Top Box) as an image-receiving device for cable TV and the like, an AV (Audio Visual) amplifier, a PDA (Personal Digital Assistants), a semiconductor memory player, a mobile phone, a digital TV set, a digital BS tuner, and a CS tuner. Thus, by using the connecter of the present invention for various electronic devices, it is possible to connect between such devices and to exchange optical signals, while taking advantage of features of the respective electronic devices.

Moreover, because the connecter of the present invention stabilizes connection between a device and a cable, it is possible to provide a user-friendly electronic device requiring high quality and high speed communication.

The connecter of the present invention is suitable for connecting not only between a device and an optical cable, but also between a device and other cables (copper wires).

Figure 9:
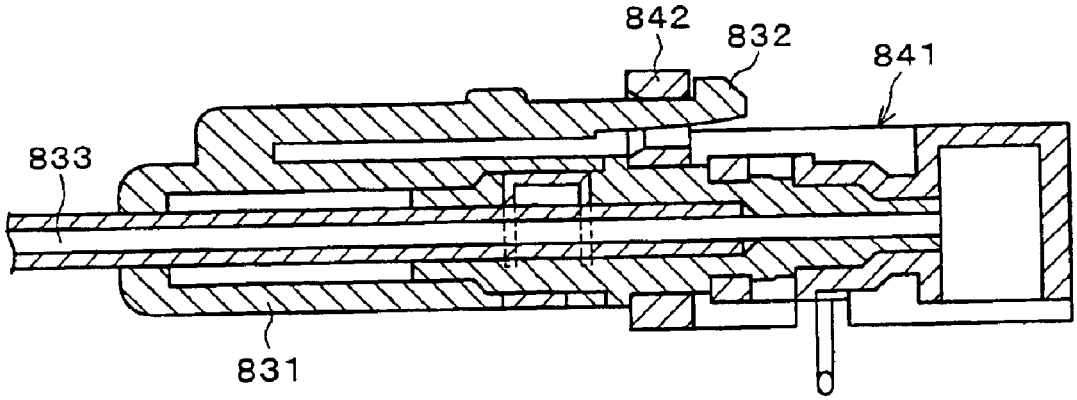
FIG. 9 Related Art
FIG. 9 is a longitudinal cross-sectional view illustrating a state in which conventional mechanical lock plug and connecter are connected.

As described above, the connecter of the above arrangement, which is so structured as to be capable of dealing with the mechanical lock plug 200 that is capable of being downsized can be more downsized than the conventional connecter for the mechanical lock plug shown in FIG. 9 can.

Moreover, because the mechanical lock plug 200 is so shaped as to be rotationally symmetric, the mechanical lock plug 200 has a merit of being user-friendly in that it is not necessary to turn over the mechanical lock plug 200 in inserting the mechanical lock plug 200.

As described above, a mechanical lock type connecter of the present invention, into and from which inserted and detached is a plug having (a) a non-movable member connected to a cable and (b) a movable member for moving relatively to the non-movable member and to the cable, may be so arranged as to include plug holding and releasing means for (c) holding the non-movable member in accordance with movement of the movable member in a plug inserting direction caused by inserting a plug, and (d) releasing the plug in accordance with movement of the movable member in a plug detaching direction.

Because of this, in a state in which the plug is inserted in the connecter, the movable member, which deals with holding and releasing of the plug, is not displaced even if the cable is pulled, thus preventing the plug from being detached from the connecter.

In other words, because the plug is inserted into and detached from the connecter in accordance with the movement of the movable member provided to the plug and movement of the plug holding and releasing means provided to the connecter, the plug and the connecter are connected by mechanical locking.

According to the connecter of the arrangement above, therefore, because a plug of a structure suitable for downsizing is mechanically locked, it is possible to downsize the connecter itself. As a result, it is possible to downsize the connecting portions of the plug and the connecter.

In a case in which the non-movable member is provided at the tip of the plug, it may be so arranged that the plug holding and releasing means has a pressure accepting portion for moving as pressed by the movable member of the plug, and an engaging portion for moving, in accordance with movement of the pressure accepting portion, so as to engage the non-movable member of the plug in such a manner as to prevent the plug from being detached.

According to the arrangement above, the pressure accepting portion of the plug holding and releasing means is displaced as pressed by the movable member of the plug, and the engaging portion engages the non-movable member of the plug so as to prevent the plug from being detached. Therefore, it is possible to appropriately hold and release the plug in accordance with movement of the movable section of the plug.

It may be so arranged that the pressure accepting portion and the engaging portion of the plug holding and releasing means are integrally formed, and biased toward a direction of a center of the plug. For example, it may be so arranged that the pressure accepting portion and the engaging portion are pressed toward a direction of a center of the plug by elastic material such as a spring.

According to the arrangement above, the pressure accepting portion is pushed away by the movable member of the plug in accordance with insertion of the plug, and the pressure accepting portion and the engaging portion are displaced so as to spread out from the center of the plug. As the plug is further inserted, the pressure accepting portion is displaced along a surface of the movable member, and the engaging portion holds the non-movable member of the plug.

It may be so arranged that the pressure accepting portion and the engaging portion, which are integrated, are provided in the plug inserting direction in this order (so that the plug first touches the pressure accepting portion, and then touches the engaging portion), and are biased in the direction of the plug, at the fulcrum as a center provided externally to the pressure accepting portion.

According to the arrangement above, it is easy to downsize the plug holding and releasing means for causing, by using elasticity thereof, the engaging section to engage the non-movable member of the plug.

It may be so arranged that a part of the engaging portion that is to be contacted with the plug is so shaped as to fit the non-movable member of the plug.

According to the arrangement above, it is possible to hold the plug more stably when the plug is inserted into the connecter.

It may be so arranged that, in addition to the arm sections in each of which the pressure accepting portion and the engaging portion are integrated, a holder section for containing the arm section is provided.

According to the arrangement above, it is possible not only to form the arm section by simple integral molding, but also to attain a dust control effect, a light shielding effect, and an electromagnetic shielding effect of the holder section.

It may be so arranged that the arm sections face with each other, and that there are provided hooks, in a direction vertical to the arm sections when seen from the plug, for fixing the arm sections to the holder section.

According to the arrangement above, it is possible to stably hold the plug by the pair of arm sections and to stably fix the arm sections to the holder section. At the same time, it is also possible to downside the connecter.

It may be so arranged that the holder section has a groove for accepting one of the arm sections.

According to the arrangement above, the arm sections are not twisted, but are stably displaced as to spread out from the center of the plug. Therefore, it is possible to mitigate deterioration of the arm sections caused by inserting and detaching the plug, and to easily reproduce deterioration of the arm sections due to repeated inserting and detaching of the plug.

It may be so arranged that, in addition to the arm sections, there is provided a plug insertion detecting switch, in such a position as not to be hampered by movement of the arm sections, for detecting the insertion of the plug into the connecter.

According to the arrangement above, because the plug insertion detecting switch is provided in such position as not to be hampered by the movement of the arm sections, it is possible to downsize the connecter.

It may be so arranged that the holder section has an inclined portion for guiding the non-movable member of the plug.

According to the arrangement above, it is possible to provide such a connecter in which the tip of the non-movable section of the plug is held always at a stable position, even if inserting and detaching of the plug are repeated.

The optical connecter is applicable to a variety of electronic devices.

The present invention provides a connecter that is so structured as to deal with a mechanical lock plug. Until now, no specific structure of a connecter for a mechanical lock plug has been disclosed. However, the present invention makes it possible to provide a less expensive and compact connecter for a mechanical lock plug.

It is intended that the connecter of the present invention be basically used in a high-performance electronic device. If the mechanical lock is provided to the connecter, a weak shock rarely causes the plug to be easily detached from the connecter, or the connecter and the plug to be easily mismatched. Therefore, the connecter of the present invention is suitable for such an electronic device for which high quality and high speed communication is necessary. For example, the connecter of the present invention is suitable for a personal computer and peripheral devices therefor (such as a built-in or external hard disk drive, a CD-ROM, a CD-R, a CD-RW, a DVD-ROM, a DVD-±R, a DVD-RW, and a DVD-RAM), an audio equipment, a video equipment, and the like.

Because the connecter of the present invention stabilizes the connection between the device and the cable, it is possible to provide a user-friendly electronic device that should be able to perform high quality and high speed communication.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A mechanical lock type connecter, comprising:

a non-movable member connected to a cable;

a movable member that makes relative movement in an axial direction of the cable independently from the non-movable member and the cable; and plug holding and releasing means for (a) holding the non-movable member in accordance with movement of the movable member in a plug inserting direction caused by inserting a plug, and (b) releasing the plug by movement of the movable member in a plug detaching direction, wherein:

the plug holding and releasing means includes a pressure accepting portion for accepting pressure from the movable member so as to be pushed away, in accordance with the movement of the movable member in the plug inserting direction caused by inserting the plug, and an engaging portion for engaging, by being displaced, the non-movable member of the plug in accordance with movement of the pressure accepting portion so as to prevent the plug from being detached.

2. The mechanical lock type connecter as set forth in claim 1, wherein:

the pressure accepting portion and the engaging portion are integrally formed, and are biased toward a direction of a center of the plug when the plug is inserted.

3. The mechanical lock type connecter as set forth in claim 2, wherein:

the pressure accepting portion and the engaging portion are positioned in the plug inserting direction in this order, and are biased, toward the direction of the center of the plug when the plug is inserted, in such a manner as to be circularly displaced at a fulcrum as a center that is positioned opposite to the engaging portion.

4. The mechanical lock type connecter as set forth in claim 1, wherein:

a part of the engaging portion that is to be contacted with the plug has such a shape as to fit the non-movable member of the plug therein.

5. The mechanical lock type connecter as set forth in claim 1, wherein:

the plug holding and releasing means includes a pair of arm sections in which the pressure accepting portion and the engaging portion are integrated, the mechanical lock type connecter further comprising a holder section for containing the arm sections.

6. The mechanical lock type connecter as set forth in claim 5, wherein:

the pair of arm sections face each other, the mechanical lock type connecter further comprising hooks, positioned in a direction that is perpendicular, when seen from the plug, to the arm sections, for fixing the arm sections to the holder section.

7. The mechanical lock type connecter as set forth in claim 5, wherein:

the holder section has a groove for accepting one of the arm sections.

8. The mechanical lock type connecter as set forth in claim 5, further comprising:

a plug insertion detecting switch, which is so positioned as not to be hampered by movement of the arm sections, for detecting insertion of the plug into the connecter.

9. The mechanical lock type connecter as set forth in claim 5, wherein:

the holder section has an inclined portion for guiding the non-movable member of the plug.

10. An electronic device, comprising:

a mechanical lock type connecter including a non-movable member connected to a cable, a movable member that makes relative movement in an axial direction of the cable independently from the non-movable member and the cable, and plug holding and releasing means for (a) holding the non-movable member in accordance with movement of the movable member in a plug inserting direction caused by inserting a plug, and (b) releasing the plug by movement of the movable member in a plug detaching direction, wherein:

the plug holding and releasing means includes a pressure accepting portion for accepting pressure from the movable member so as to be pushed away, in accordance with the movement of the movable member in the plug inserting direction caused by inserting the plug, and an engaging portion for engaging, by being displaced, the non-movable member of the plug in accordance with movement of the pressure accepting portion so as to prevent the plug from being detached.

11. A mechanical lock type connecter, comprising:

a non-movable member connected to a cable;

a movable member that makes relative movement in an axial direction of the cable independently from the non-movable member and the cable; and plug holding and releasing member for (a) holding the non-movable member in accordance with movement of the movable member in a plug inserting direction caused by inserting a plug, and (b) releasing the plug by movement of the movable member in a plug detaching direction, wherein:

the plug holding and releasing means includes a pressure accepting portion for accepting pressure from the movable member so as to be pushed away, in accordance with the movement of the movable member in the plug inserting direction caused by inserting the plug, and an engaging portion for engaging, by being displaced, the non-movable member of the plug in accordance with movement of the pressure accepting portion so as to prevent the plug from being detached.

* * * * *